United States Patent [19]

De Filippis et al.

[11] Patent Number: 4,768,284

[45] Date of Patent: Sep. 6, 1988

[54] A METHOD FOR MAKING LOW PROFILE MICROSWITCHES, PARTICULARLY USEFUL FOR KEYBOARDS

[75] Inventors: Pietro De Filippis; Amedeo Salvatore; Luigi Abbondandolo, all of Naples, Italy

[73] Assignee: Texas Instruments Incorporated, Dallas, Tex.

[21] Appl. No.: 539,510

[22] Filed: Oct. 6, 1983

Related U.S. Application Data

[60] Continuation of Ser. No. 401,435, Jul. 23, 1982, abandoned, which is a division of Ser. No. 175,230, Aug. 5, 1980, Pat. No. 4,352.963.

[30] Foreign Application Priority Data

Feb. 6, 1979 [IT] Italy ..... 47900 A/79

[51] Int. Cl.[4] ..... H01H 11/06

[52] U.S. Cl. ..... 29/622; 29/450

[58] Field of Search ..... 29/622, 520, 509, 450, 29/848, 849; 200/1 R, 5 R, 5 A, 159 B, 275, 279, 292, 294, 306

[56] References Cited

U.S. PATENT DOCUMENTS 3,458,930 8/1969 Melkeraaen et al. ..... 200/5 R 3,725,907 4/1973 Boulanger ..... 200/5 E 3,967,084 6/1976 Pounds ..... 200/5 R 4,074,088 2/1978 Keough et al. ..... 200/5 R

*Primary Examiner*—P. W. Echols

*Attorney, Agent, or Firm*—John A. Haug; James P. McAndrews; Melvin Sharp

[57] ABSTRACT

A keyboard unit is shown having a substrate in which portions of the substrate are physically displaced to provide a cavity, an embossment and a plurality of protuberances for each switching station. The embossment, in registry with a button contact area, projects upwardly from the floor of the cavity a selected distance with a discontinuous annulus contact area extending around its respective cavity in generally the same plane as that in which the top surface of the substrate lies. The cavity includes a channel shaped portion extending through the discontinued portion of the discontinuous annulus. The protuberances project upwardly from the general plane of the substrate's top surface and serve to laterally locate a snap-acting disc over the contact areas. The disc may be selectively coated with highly electrically conductive material to optimize electrical switching. A piece of flexible, electrically insulative sheet may be placed over the unit to seal it from the environment.

5 Claims, 3 Drawing Sheets

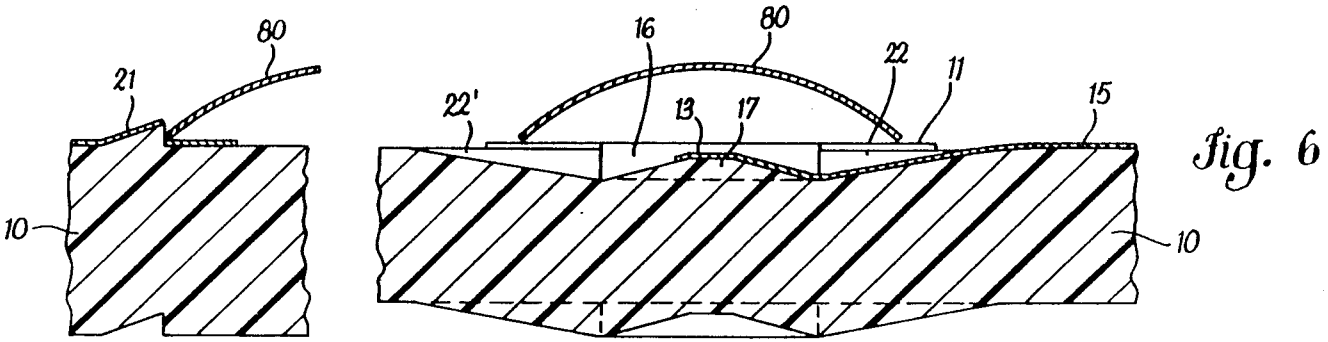
Fig. 6
Fig. 7
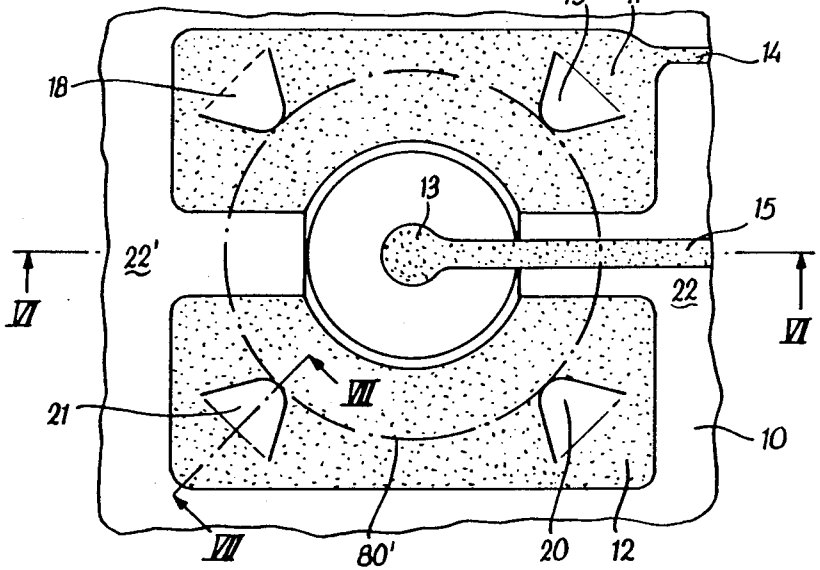
Fig. 5

A METHOD FOR MAKING LOW PROFILE MICROSWITCHES, PARTICULARLY USEFUL FOR KEYBOARDS

This application is a continuation of Ser. No. 401,435 filed July 23, 1982, abandoned, which is a divisional of Ser. No. 175,230 filed Aug. 5, 1980, now U.S. Pat. No. 4,352,963.

The invention relates to an improvement in the method for making low profile microswitches particularly useful for the composition of keyboards.

More particularly the present invention relates to a microswitch of the above-said kind which may be realized on a printed circuit with low cost and high reliability.

Low profile microswitches are known, which use a spherical cap member as a movable switching element normally having the convexity directed outwardly. When a pressure is exerted on the spherical cap it inverts its curvature with a snap action and electrically closes contacts located on an insulating panel.

However, this known construction of low profile switches results in production costs which are relatively high, as well as having a relatively large number of components to be assembled.

An object of this invention is to provide a method for making an improved structure for low profile microswitches, utilizing as a main switching member an element shaped as a spherical cap. Another object of the invention is the provision of a method of making a low cost, highly reliable keyboard having fewer parts to assemble than many prior art keyboards. Other objects and features of this invention will be in part apparent and in part pointed out hereinafter.

SUMMARY OF THE INVENTION

Briefly, according to the invention, a low profile keyboard unit comprising an electrically insulating substrate, such as a phenolic bonded fibre substrate, is formed with conventional printed circuit areas including one or more switching stations, each station comprising a discontinuous, generally annular contact area and an inner button contact area centrally disposed therein. For each station, portions of the substrate are displaced, as by means of a half punching operation to provide a cavity, an embossment and a plurality of protuberances. The embossment projects upwardly from the bottom of the cavity and is in registry with the inner button contact area. The inner portion of the annular contact area is also disposed within the cavity while the protuberances extend above the general plane of the substrate of the substrate and are disposed around the annular contact area in such a manner so as to laterally locate a snap-acting disc over the contact areas. The cavity also includes a channel shaped portion extending through the discontinued portion of the discontinuous annulus. The snap-acting discs may be plated with highly electrically conductive metal in selected areas adapted to come into physical engagement with the contact areas of the substrate. A sheet of adhesive coated flexible material may be placed over the substrate and discs to protect the unit from the environment.

BRIEF DESCRIPTION OF THE DRAWINGS

The present invention will be now disclosed with reference to a presently preferred embodiment referred to as an illustration, without limitations, and on the basis of the attached drawings, wherein:

FIG. 5 shows a top plan view of a microswitch according to the present invention in greater detail;

FIG. 6 shows a sectional view along line VI—VI of FIG. 5;

FIG. 7 shows a partial sectional view of line VII—VII of FIG. 5; and

Corresponding reference characters indicate corresponding parts throughout the several views of the drawings.

DESCRIPTION OF THE PREFERRED EMBODIMENT

Reference is now made to the drawings and in particular to FIGS. 1 to 4.

Figure 1:
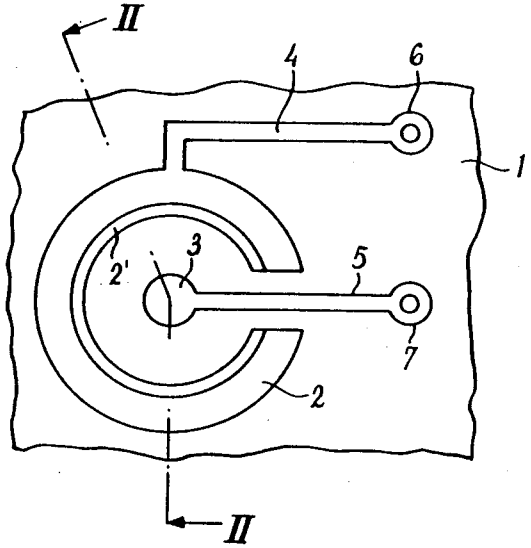
FIG. 1 shows a top plan view of a portion of printed circuit whereon the static or fixed contacts of the microswitch according to the present invention are realized.

On an insulating panel of the kind used for printed circuits, for instance, comprising a substrate 1 of fibers bonded with a phenolic resin and provided with the usual electrically conductive layer, there is obtained by conventional photoetching operations a pattern of the kind shown in said FIG. 1, comprising a first conductive area 2 having a discontinuous, substantially annular configuration and a "button" 3 located at the center of the annulus. The conductive areas 2, 3 are brought to respective conventional soldering pads 6, 7 with respective traces 4, 5.

Figure 2:
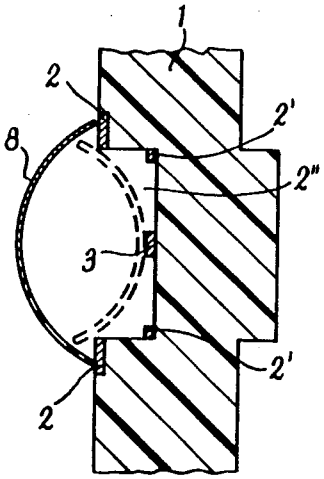
FIG. 2 shows, with exaggerated "thickness" proportions, a section along line II—II of FIG. 1.

As one can see from FIG. 2, the part 2' comprising and internal to the conducting area 2 is by means of a partial punching operation, displaced or "lowered" with respect to the general plane of the surface of the substrate 1 forming a cavity 2'', in which the "button" 3 is disposed on a plane different from the one of the conductive area 2.

In registry with the conductive area 2 there is located an electrically conductive, disc shaped spherical cap member 8, shown in full line position in FIG. 2 with the convex surface directed outwardly when the same is in the rest condition, and with dotted lines with the convex surface directed inwardly when it is in the actuated condition.

It will be seen that in the actuated condition the peripheral and central areas of the disc 8 electrically close a contact between the internal border of the conducting area 2 and the button 3. As noted above, the displaced portion of the substrate forming cavity 2'' includes a small conducting portion 2' so that the peripheral edge defining the cavity is defined by conductive area 2 to ensure good electrical contact in the actuated configuration of the disc. Additionally disc 8 is provided with highly electrically conductive metal plating on selected portions 8', 8'' for guaranteeing good electrical contact.

One will see that the dimensions of the curvature of disc 8 and the depth of cavity 2'' are greatly exaggerated with respect to the actual dimensions as it will be clear to a person skilled in the art.

Figure 3:
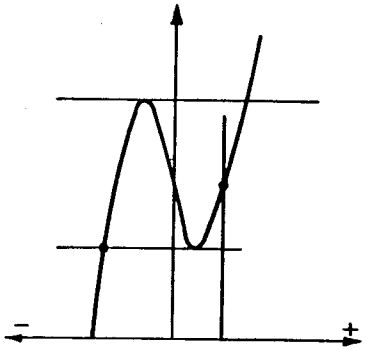
FIG. 3 shows the behavior of forces and displacements relating to the contact member having the shape of a portion of a spherical cap.
Figure 4:
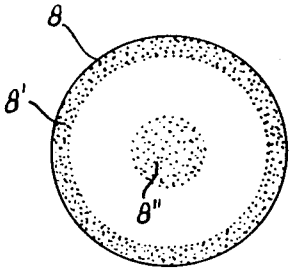
FIG. 4 shows a bottom plan view of the spherical cap element (the side of the element which makes electrical engagement with the fixed contact)

FIG. 3 shows the force/displacement relationship in the deformation action of the disc 8 for closing electric contact providing the aforesaid snap action.

What is shown in FIGS. 1–4 is exemplary to show the operation concept of the microswitch according to this invention.

Reference is now made to FIGS. 5–8.

On the insulating substrate 10, there is realized with conventional techniques used for printed circuits both the areas 11, 12 and the area 13, with respective connection traces 14, 15.

Figure 8:
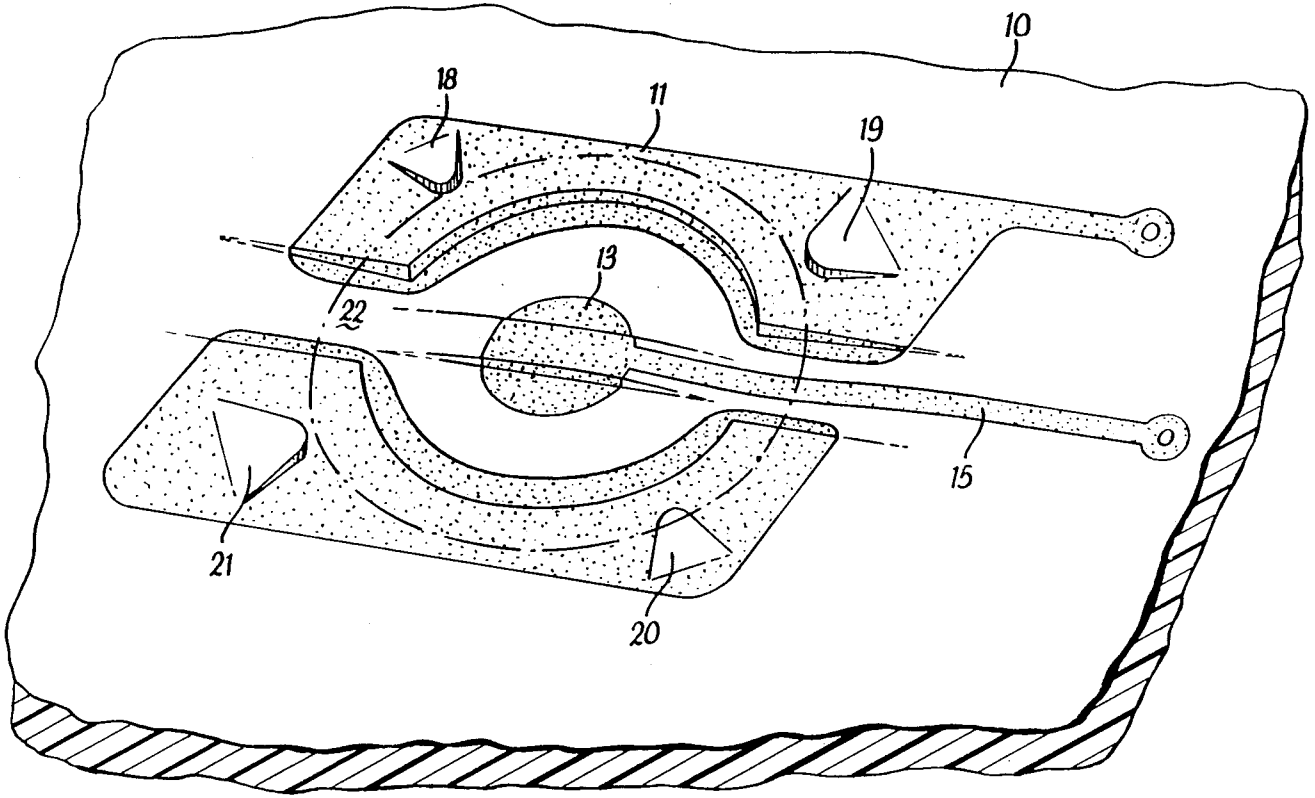
FIG. 8 shows a perspective view of the shaped printed circuit board carrying the fixed contacts of the microswitch according to the present invention.

From a combined consideration of FIGS. 5, 6, 8, it can be seen how by means of a half-punching operation, there is obtained a shifting of the planes of the substrate for obtaining cavity 16 (corresponding to cavity 2'' of FIG. 2) and an embossment 17 in registry with the contact area 13 with the opposite surface configuration formed in the bottom surface of substrate 10.

The contact disc 80 occupies in FIG. 5 the position defined by the circle 80'.

Disc 80 is maintained centered on the circle 80' by means of a plurality of half-punched protuberances 18, 19, 20, 21 (see in particular the detail of FIG. 7).

While four half-punched protuberances are shown their number and shaping is a matter of choice. These protuberances are needed for the lateral centering of disc 80 in the correct position.

It should be noted that the half-punching that forms cavity 16 and embossment 17 forms also a channel 22, 22' useful both for allowing the air enclosed by disc 80 to escape, as well as for allowing passage of trace 15 as well as other traces of interconnections of the printed circuit which are not directly related to the switch of the invention.

The unit may be covered with a sheet of adhesive coated, electrically insulative flexible material, for example, "Mylar" for the protection of the switch against the environment.

It should be noted also that embossment 17 may be formed by the mechanical operation so that it protrudes beyond the upper plane of the substrate 15, if desired, for utilizing a movable contact member shaped as a "top hat". That is, a contact member provided with some type of feet or rim to raise the deformable portion of the disc above the plane of the contact member support.

Naturally, on a single substrate 10 a plurality of microswitches of the above-said kind may be realized for constituting keyboards with the desired number of switching points.

With the structure according to the present invention there are obtained among others, the following advantages:

(a) elimination of the usual disc retaining member;

(b) elimination of the staples of conventional keyboards of this kind;

(c) greater reliability owing to the fact that fewer parts are employed as well as the elimination of the wave soldering operations of the staples; and (d) the possibility of using a panel with a single metallized layer thereby resulting in lower costs.

In view of the above, it will be seen that the several objects of the invention are accrued and other advantageous results atatined.

As various changes could be made in the above constructions without departing from the scope of the invention, it is intended that all matter contained in the above description or shown in the accompanying drawings shall be interpreted as illustrative and not in a limiting sense.

We claim:

1. A method of making a low profile keyboard in which a snap-acting disc is employed as a switching element between contact areas at each of a plurality of microswitches comprising the steps of selecting a substrate having a generally flat top and bottom planar surface and having an electrically insulative surface thereon, for each microswitch forming a first electrically conductive contact area on the surface, forming a second electrically conductive contact area on the surface spaced from each first contact area, punching the substrate so that a plurality of protuberances extending above the flat top surface are formed spaced around each microswitch to maintain a disc at a selected location relative to the contact areas, a respective depression being formed in the bottom surface aligned with each protuberance.

2. A method according to claim 1 in which the punching step includes forming a channel which extends from a point adjacent the second contact area to a point more remote from the second contact area than the protuberances.

3. A method according to claim 1 in which the substrate is punched so that a cavity aligned with the second conductive contact area is formed in the top planar surface at each mircoswitch, the cavity in the top surface extending to a selected depth from the top planar surface, the bottom planar surface being formed with a surface configuration protruding below the bottom planar surface beneath the cavity in the top surface and in alignment therewith.

4. A method according to claim 3 in which the substrate is punched in such a manner that a cavity having a floor is formed which includes a portion of the first contact area and encompasses the second contact area and a portion of the second contact area extends along the floor of the cavity.

5. A method according to claim 1 in which the substrate is composed of fibres bonded with resin.

* * * * *